US007654831B1

(12) United States Patent
Wu

(10) Patent No.: US 7,654,831 B1
(45) **Date of Patent: *Feb. 2, 2010**

(54) CABLE ASSEMBLY HAVING IMPROVED CONFIGURATION FOR SUPPRESSING CROSS-TALK

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 4 days.

This patent is subject to a terminal disclaimer.

(21) Appl. No.: 12/218,862

(22) Filed: Jul. 18, 2008

(51) Int. Cl.
*H01R 12/00* (2006.01)

(52) U.S. Cl. ..... 439/76.1; 439/941; 439/607.46

(58) Field of Classification Search ..... 439/76.1, 439/941, 607.01, 607.46
See application file for complete search history.

(56) References Cited

U.S. PATENT DOCUMENTS 5,219,294 A 6/1993 Marsh et al.
5,873,743 A * 2/1999 Tkazyik et al. ..... 439/76.1
6,699,073 B1 * 3/2004 Wu ..... 439/607.06
6,739,910 B1 * 5/2004 Wu ..... 439/607.06
6,865,369 B2 * 3/2005 Semmeling et al. ..... 434/357
6,899,566 B2 * 5/2005 Kline et al. ..... 439/607.56
7,134,914 B1 11/2006 Wu

* cited by examiner

*Primary Examiner*—Tho D Ta
*Assistant Examiner*—Travis Chambers
(74) *Attorney, Agent, or Firm*—Wei Te Chung; Andrew C. Cheng; Ming Chieh Chang

(57) ABSTRACT

A cable assembly (1000) includes a housing (1) has a receiving space (10), said receiving space including a hollow portion and a mating port located in front of the hollow portion; a spacer (4) located in the receiving space; a first and second printed circuit boards (31, 32) partially enclosed within the spacer and arranged apart from one another, both the first and second printed circuit boards having mating interfaces extending into the mating port and mounting portions disposed in the hollow portion; a metallic plate (2) assembled to the spacer and disposed between the pair of first and second printed circuit boards; a plurality of cables (7) coupled to the mounting portions of the pair of first and second printed circuit boards, respectively.

17 Claims, 8 Drawing Sheets

CABLE ASSEMBLY HAVING IMPROVED CONFIGURATION FOR SUPPRESSING CROSS-TALK

FIELD OF THE INVENTION

The present invention generally relates to a cable assembly, and more particularly to a cable assembly having an improved structure for suppressing cross-talk to acquire better signal transmission property.

DESCRIPTION OF PRIOR ART

PCI Express, officially abbreviated as PCI-E or PCIe, is a computer expansion card interface format introduced by Intel in 2004. It was designed to replace the general-purpose PCI expansion bus, the high-end PCI-X bus and the AGP graphics card interface. Unlike previous PC expansion interfaces, rather than being merely a bus, it is configured around point-to-point full duplex serial links called lanes. In PCIe 1.1 (the most common version as of 2007) each lane carries 250 MB/s in each direction.

PCI Express External Cabling which extends the PCI Express interconnects architecture "outside the box." Cables using the PCIe technology will be used for external applications, as well as applications internal to an enclosure that need a cable connection. PCI Express External Cabling Specification, REV. 1.0 introduced four kinds of cable assemblies x1, x4, x8 and x16, and among which the x16 cable assembly may reach highest transmitting rate. The x16 cable assembly includes a housing, a pair of stacked PCBs accommodated in a space of the housing and four cables terminated to corresponding the PCBs. However, when signals are transmitted via the pair of stacked PCBs, cross-talk phenomena therebetween may have negative effect on electrical property of a signal transmitting line.

Hence, an improved cable assembly is highly desired to overcome the aforementioned problems.

SUMMARY OF THE INVENTION

Accordingly, an object of the present invention is to provide a cable assembly having an improved structure that can reduce cross-talk around a mating interface thereof.

In order to achieve the object set forth, a cable assembly in accordance with the present invention comprises a housing has a receiving space, said receiving space including a hollow portion and a mating port located in front of the hollow portion; a spacer located in the receiving space; a first and second printed circuit boards partially enclosed within the spacer and arranged apart from one another, both the first and second printed circuit boards having mating interfaces extending into the mating port and mounting portions disposed in the hollow portion; a metallic plate assembled to the spacer and disposed between the pair of first and second printed circuit boards; a plurality of cables coupled to the mounting portions of the pair of first and second printed circuit boards, respectively.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
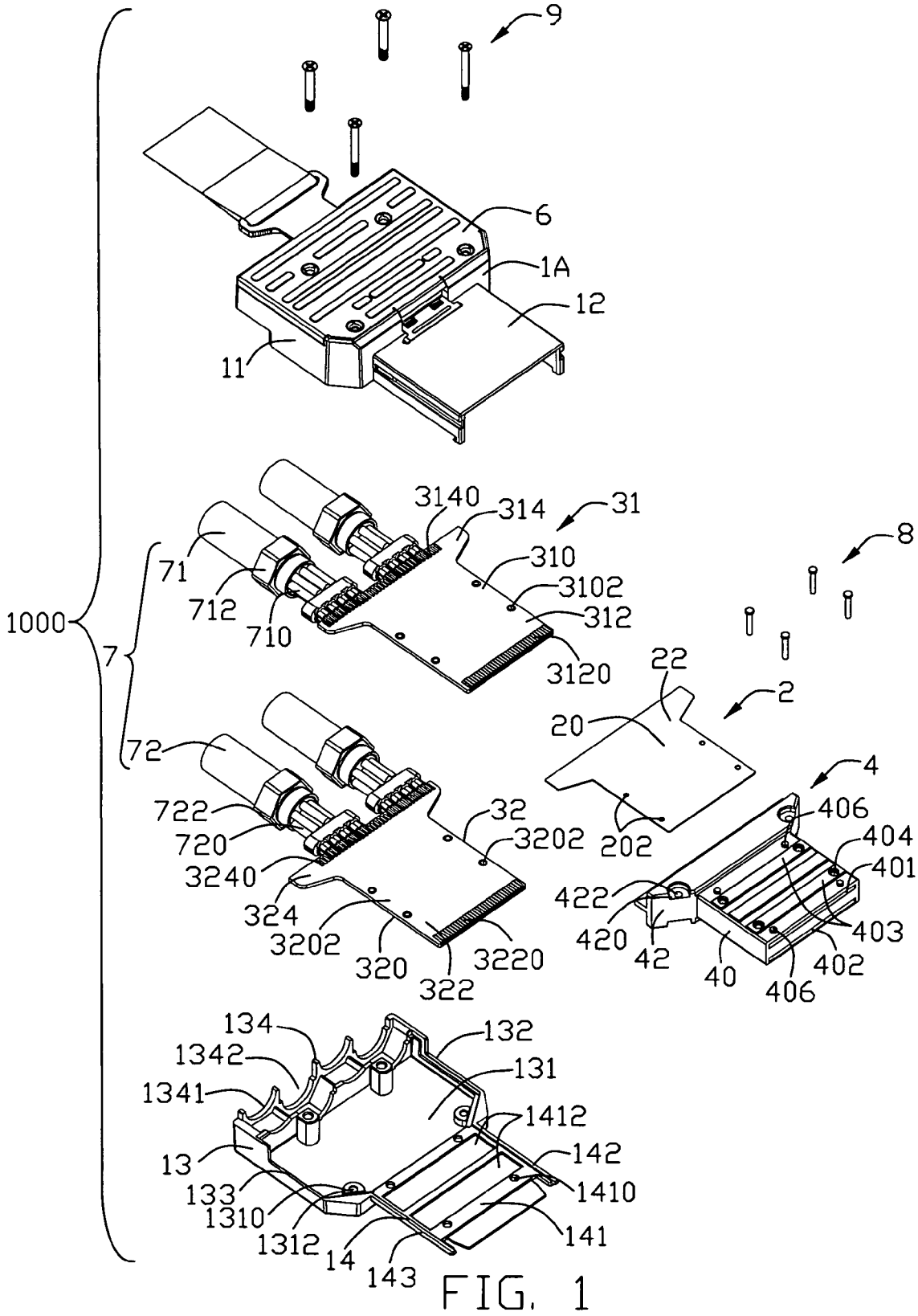
FIG. 1 is an exploded, perspective view of a cable assembly in accordance with the present invention.
Figure 2:
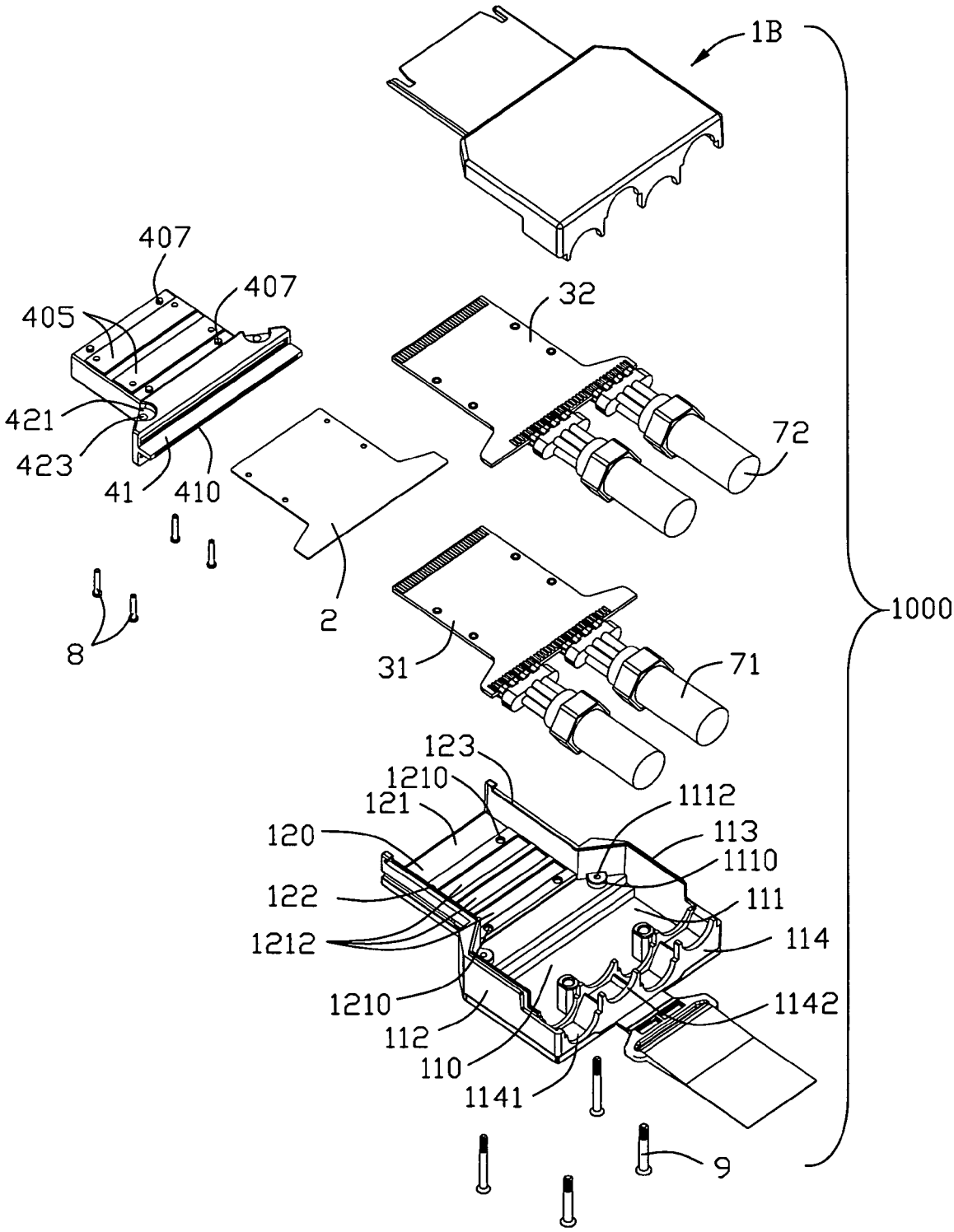
FIG. 2 is similar to FIG. 1, but viewed from another aspect.
Figure 3:
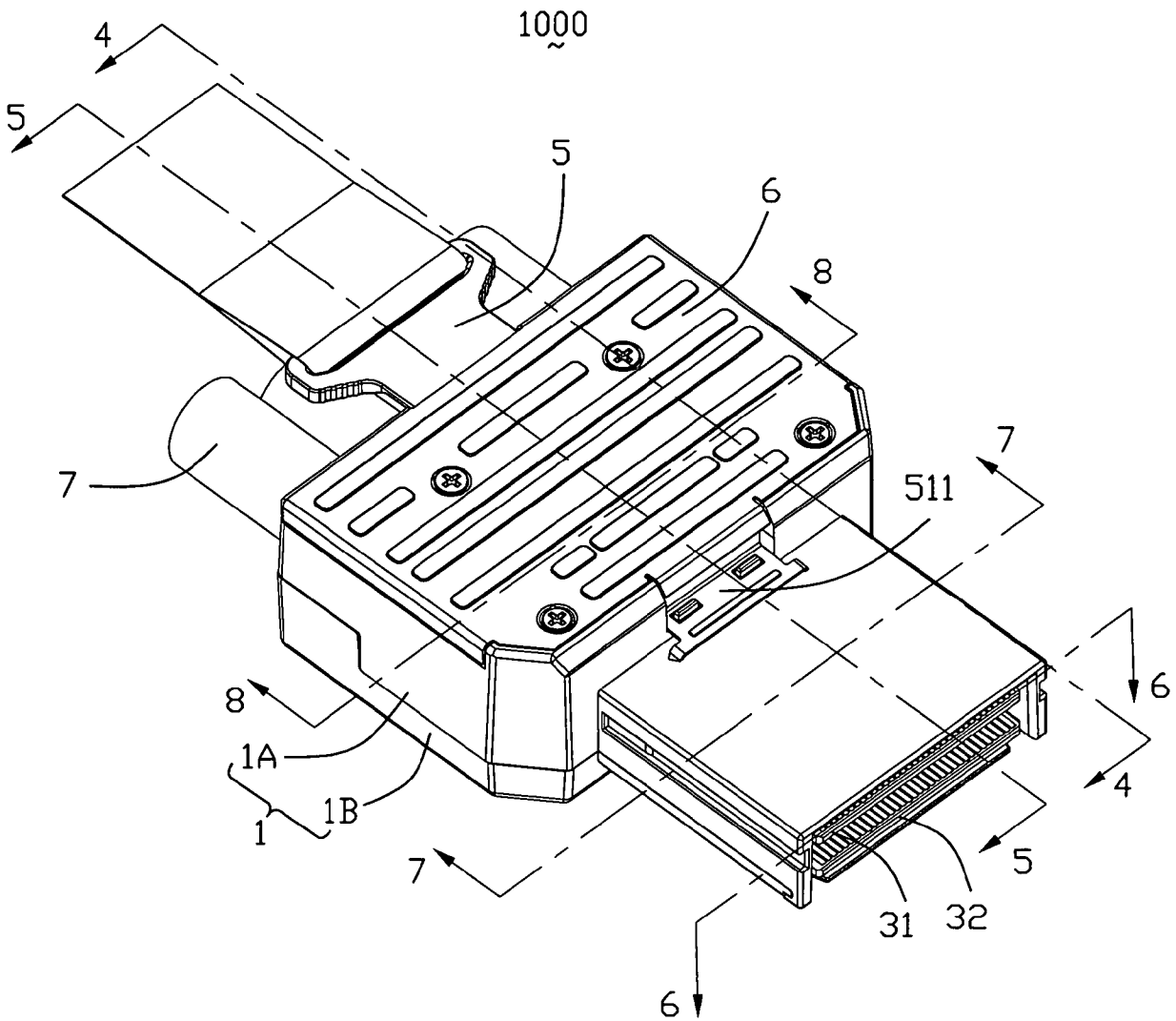
FIG. 3 is an assembled, perspective view of the cable assembly.
Figure 4:
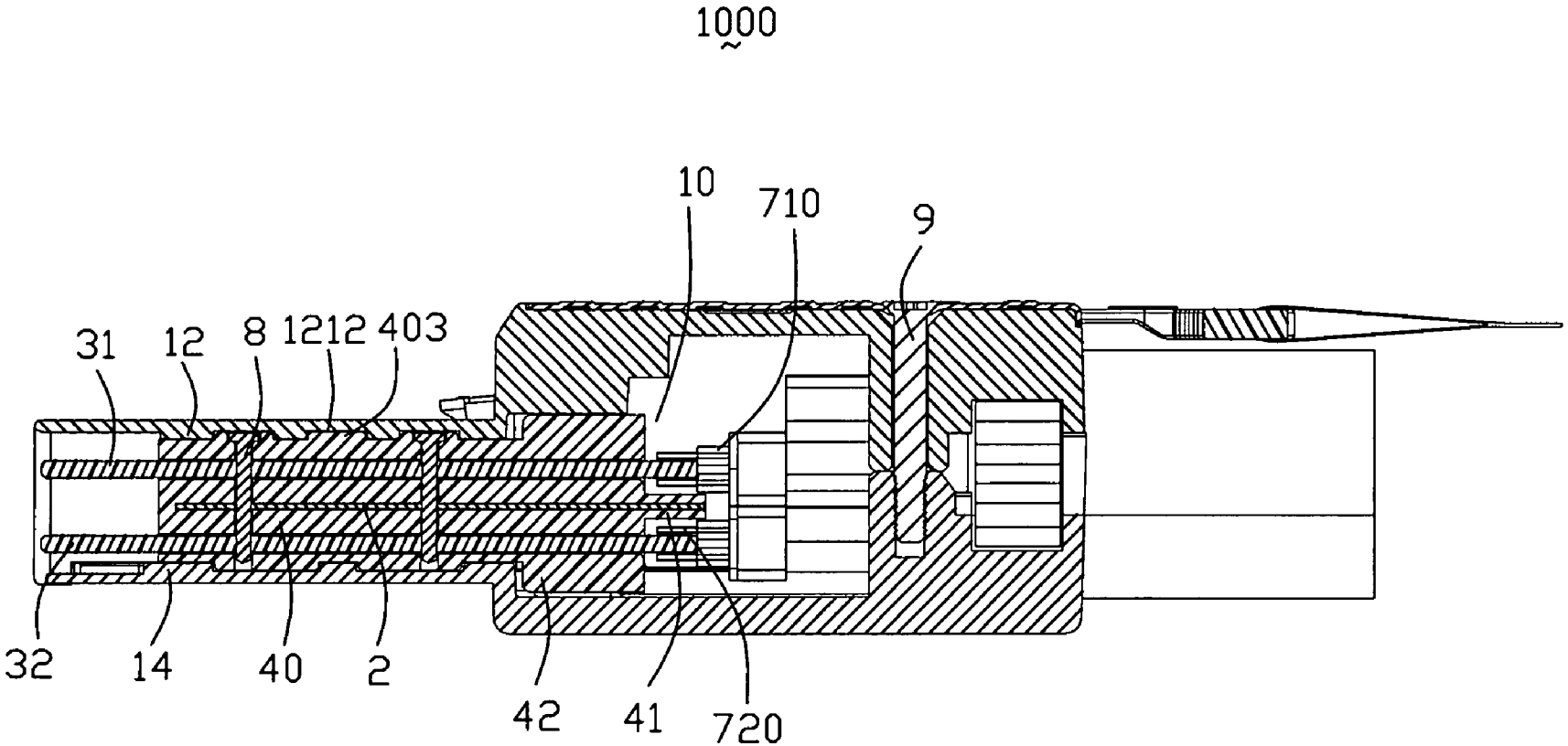
FIG. 4 is a cross-section view taken along line 4-4 of FIG. 3.
Figure 5:
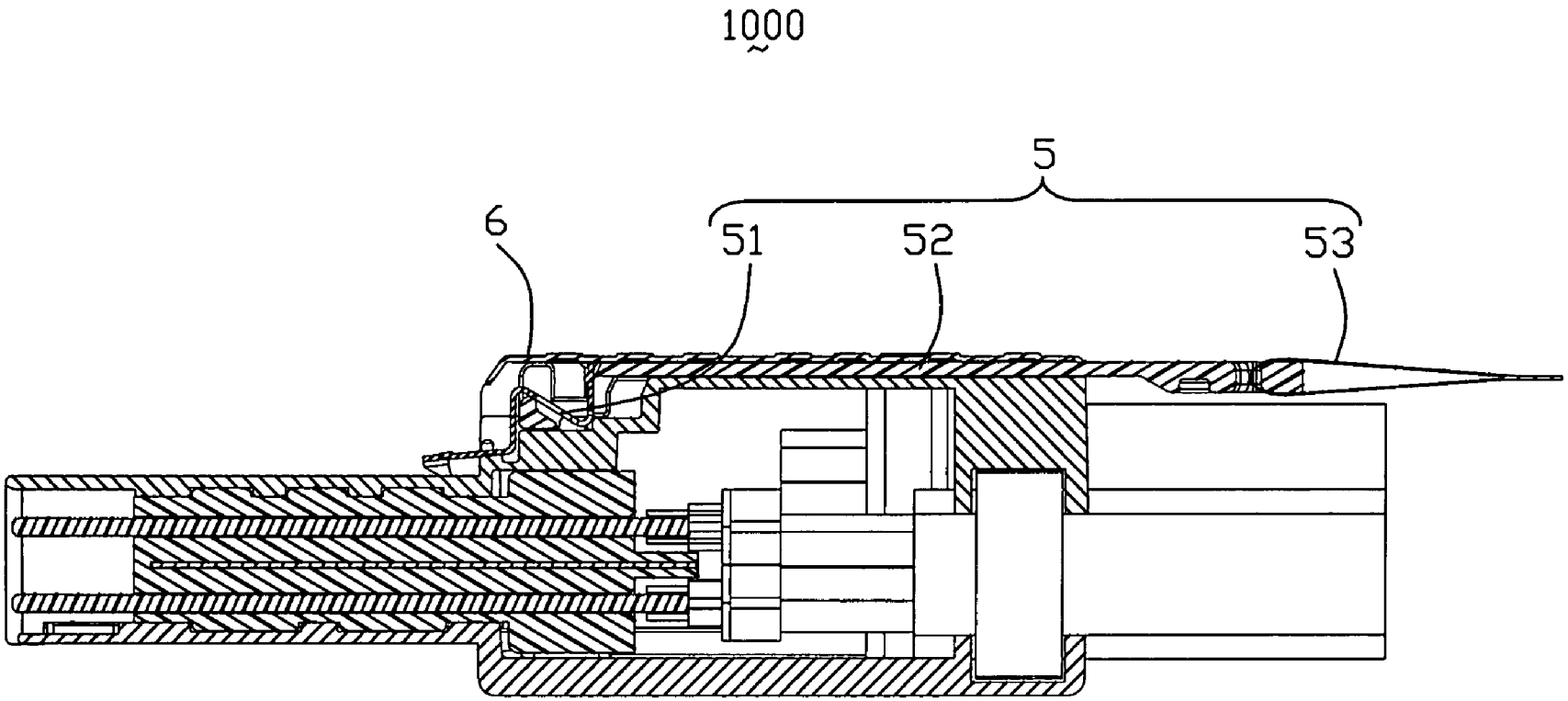
FIG. 5 is a cross-section view taken along line 5-5 of FIG. 3.
Figure 6:
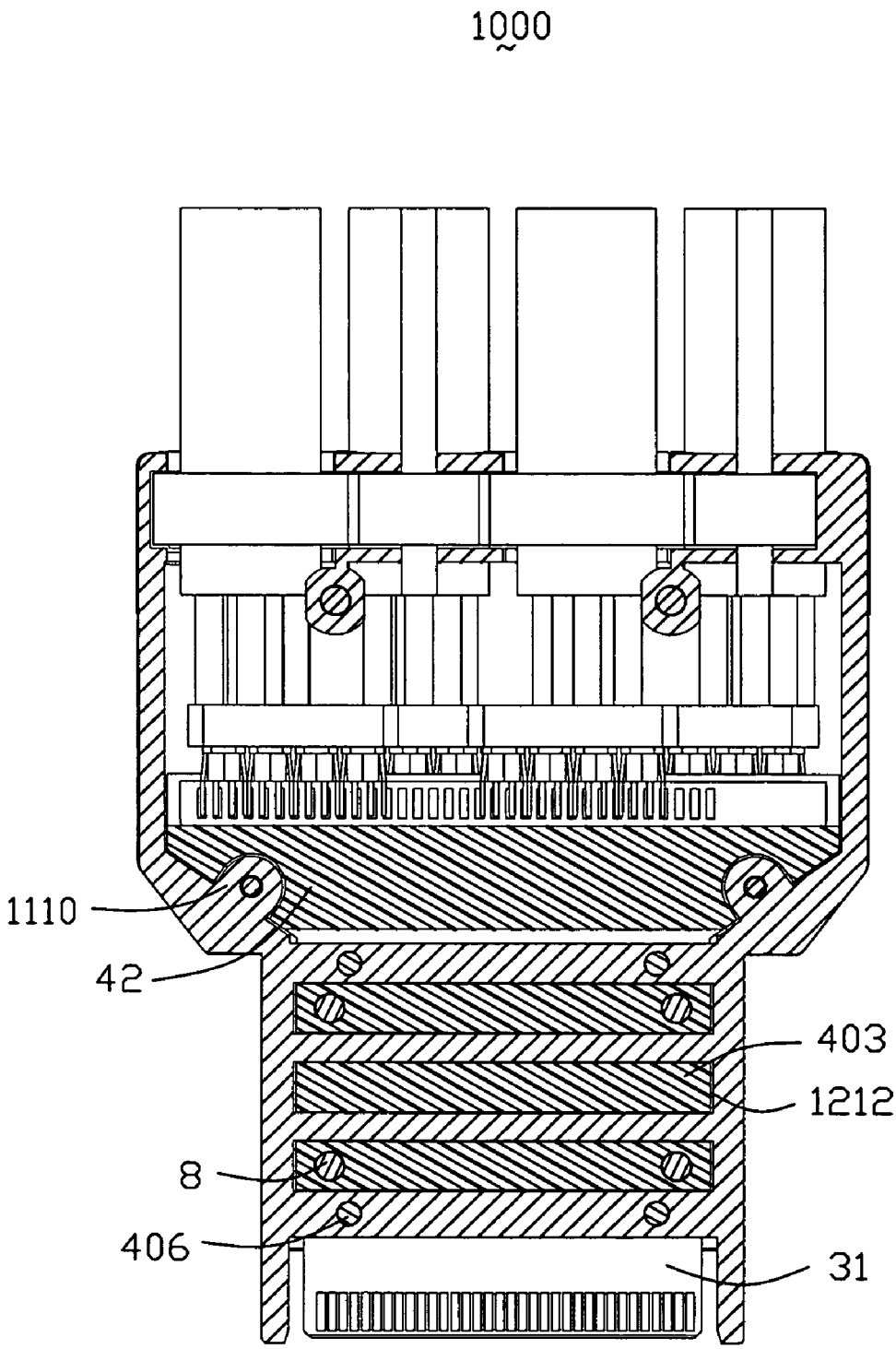
FIG. 6 is a cross-section view taken along line 6-6 of FIG. 3.
Figure 7:
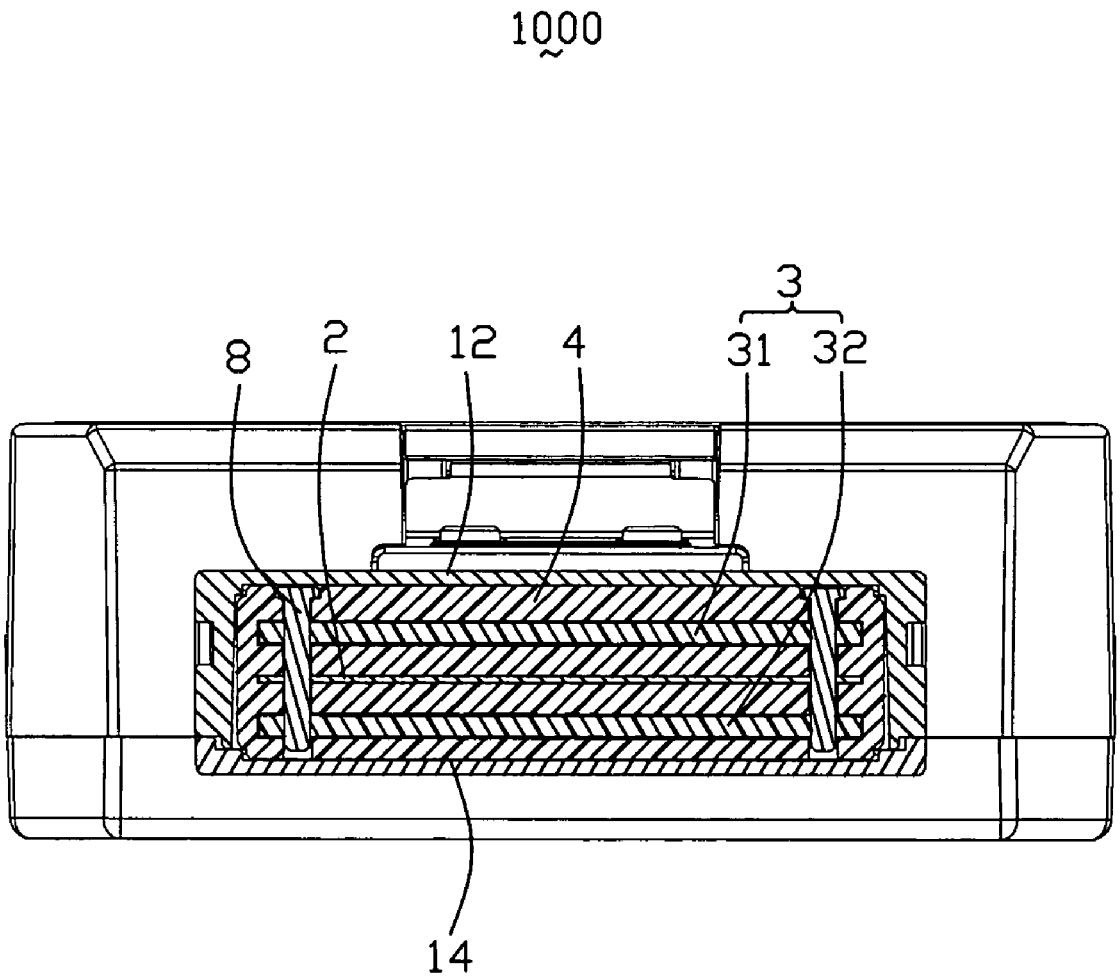
FIG. 7 is a cross-section view taken along line 7-7 of FIG. 3.
Figure 8:
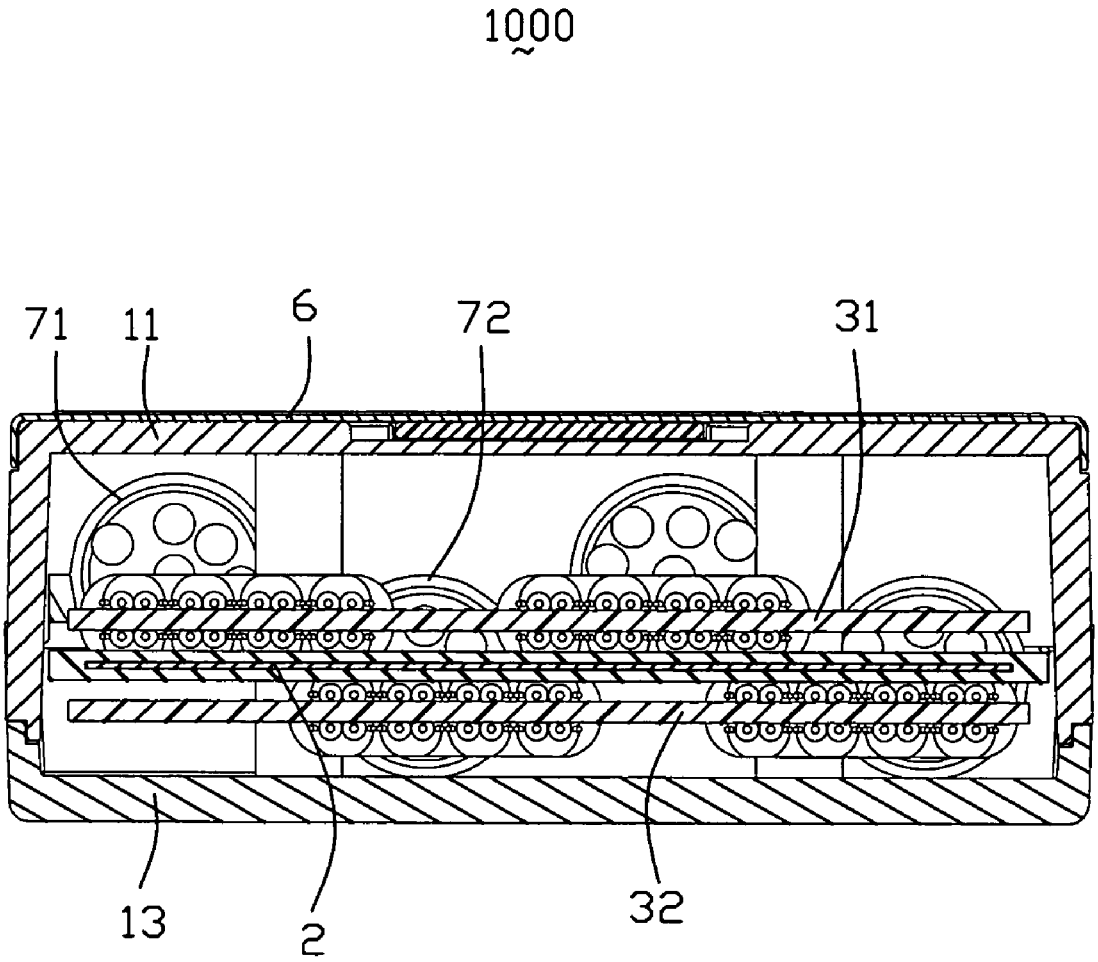
FIG. 8 is a cross-section view taken along line 8-8 of FIG. 3.

Referring to FIGS. 1-3 and in conjunction with FIGS. 4-9, a cable assembly 1000 in accordance with the present invention comprises a housing 1, a metallic plate 2, a pair of printed circuit boards (PCBs) 31, 32, a spacer 4, a latch mechanism 5, a cap member 6 and four cables 7.

The housing 1 having a first shield part 1A and a second shield part 1B together enclosing a receiving space 10 therein. Both the first shield part 1A and the second shield part 1B are made of metallic material and formed by die-cast process.

The first shield part 1A comprises an expanded first base portion 11 and a relative slim first mating portion 12 extending forwardly from a front edge of the first base portion 11. The first base portion 11 has a top wall 111, a pair of side walls 112, 113 and a rear wall 114 together forming a hollow portion 110. Four cavities 1141, 1142 are defined in a rear wall 114 and arranged in a row along transversal direction. The first mating portion 12 has a top side 121, a pair of transversal sides 122, 123 corporately forming a mating port 120 located in front of and communicating with the hollow portion 110. Two pair of first positioning cavities 1210 are spaced apart each other and arranged at lateral sides of an inner side of the top side 121. Three first positioning grooves 1212 are defined in the top side 121 and disposed between the first positioning cavities 1210. Two first retention members 1110 are disposed in the hollow portion 110 and located at lateral sides of a front portion of the top wall 111. Each first retention member 1110 further has a hole 1112 therein.

The second shield part 1B comprises a second base portion 13 and a second mating portion 14 extending forwardly from a front edge of the second base portion 13. The second base portion 13 has a bottom wall 131, a pair of side walls 132, 133 and a rear wall 134 extending upwardly from lateral edges and rear edge of the bottom wall 131. Four cavities 1341, 1342 are defined in a rear wall 134 and arranged in a row along transversal direction. The four cavities 1141, 1142 of the rear wall 114 cooperating with corresponding cavities 1341, 1342 of the rear wall 134 to form four cable exit outlets (not numbered). The cable exit outlets are separated into two groups and further staggered in a rear wall (not numbered) of the housing 1. The first mating portion 14 has a bottom side 141, a pair of flanges 142, 143 formed at lateral edges of the bottom side 141. Two pair of second positioning cavities 1410 are spaced apart each other and arranged at lateral sides of an inner side of the bottom side 141. Two second positioning grooves 1412 are defined in the bottom side 141 and disposed between the second positioning cavities 1410. Two second retention members 1310 located at lateral sides of an interior side of a front portion of the top wall 131. Each second retention member 1310 further has a hole 1312 therein.

The metal plate 2 has a main portion 20 and a broader rear portion 22 connected to a rear end of the main portion 20. Four through holes 202 are arranged at lateral sides of the main portion 20 and spaced apart one another.

Both the first and second PCBs 31, 32 includes middle portions 310, 320, narrower front portions 312, 322 and broader rear portions 314, 324. A group of first conductive pads 3120 arranged on the front portion 312 to form a first mating interface and a set of second conductive pads 3140 arranged on the rear portion 314 to from a first mounting portion. The set of second conductive pads 3140 are proximate left side of the rear portion 314. Similarly, a group of first conductive pads 3220 are arranged on the front portion 322 to form a second mating interface and a set of second conductive pads 3240 arranged on the rear portion 324 to from a second mounting portion. The set of second conductive pads 3240 are proximate right side of the rear portion 324. When the first and second PCBs 31, 32 are accommodated in the space 10 of the housing 1, the group of first conductive pads 3120 of the first PCB 31 align with the group of first conductive pads 3220 of the second PCB 32 along a vertical direction, while the set of second conductive pads 3140 of the first PCB 31 offset the set of second conductive pads 3240 of the second PCB 32 along a vertical direction. Two pair of first conductive holes 3102 are respectively defined in lateral sides of the middle portion 310 of the a first PCB 31, and two pair of second conductive holes 3202 aligning with the first conductive holes 3102 are respectively defined in lateral sides of the middle portion 320 of the second PCB 32. The first conductive holes 3102 and second conductive holes 3202 are respectively connected to grounding traces (not shown) of the first PCB 31 and the second PCB 32.

The spacer 4 is made of plastic or other insulative materials. The spacer 4 has a body portion 40, an engaging portion 42 attached to a back surface of the body portion 40 and a panel portion 41 extending rearward from a middle section of an end of the engaging portion 42. Two passages 401, 402 are respectively defined in an upper portion and a lower portion of the body portion 40 and parallel to one another. A narrow groove 410 is recessed forwardly from back surface of the panel portion 41 and disposed between the passages 401, 402. Three first bars 403 and two second bars 405 are respectively formed on a top surface and a bottom surface of the body portion 40 and spaced apart from each other. A pair of pin holes 404 pass through two of the first bars 403 and the two second bars 405. Four first positioning members 406 are arranged on the top surface of the body portion 40 and disposed outside of the first bars 403. Four second positioning members 407 are arranged on the bottom surface of the body portion 40 and respectively align with the first positioning members 406 along a vertical direction. A pair of first sunken portion 420 and a pair of second sunken portions 421 are respectively defined in an up portion and a low portion of the engaging portion 42. Either the first sunken portions 420 or the second sunken portions 421 has a tiny posts 422, 423 therein.

The first printed circuit board 31 and the second printed circuit board 32 are respectively inserted into the passages 401, 402, with middle portions 310, 320 received in the passages 401, 402 of the body portion 40, the front portions 312, 322 extending beyond a front surface of the body portion 40, and the rear portions 314, 324 disposed outside of a back surface of the engaging portion 42, without surpassing a back surface of the panel portion 41. The metal plate 2 is accommodated in the narrow groove 410 and insulated from the first and second printed circuit boards 31, 32. Four metal pins 8 are inserted into pin holes 404 of the spacer 4 and pass through the first conductive holes 3102, through holes 202 and second conductive holes 3202 to form a grounding line thereamong to reduce cross-talk between the first and second printed circuit boards 31, 32. Furthermore, the metal pins 8 also contact the first shield part 1A. However, other metal rod/post is available for linking the metallic plate 2, the first and second PCBs 31, 32 and electrically contacting the housing 1 to form another grounding line.

The cables 7 includes separated into a first set cables 71 and second set cables 72 with identical structures. The first set cables 71 and second set cables 72 have a number of wires 710, 720 respectively soldered to the second conductive pads 3140, 3240 of the first and second printed circuit boards 31, 32. The panel portion 41 may prevent short-circuit problem between the mounting portions (soldering areas) of the first and second printed circuit boards 31, 32 and the rear portion 22 of the metal plate 2. Four cable holder members 712, 722 grip front segments of the first set cables 71 and second set cables 72.

The spacer 4 is mounted to the first shield part 1A, with the body portion 40 received in the mating port 120, the engaging portion 42 received in the hollow portion 110, the first bars 403 located in the first positioning grooves 1212, the first positioning members 406 located in the first positioning cavities 1210, the first retention members 1110 disposed in the first sunken portions 420, the tiny posts 422 inserted into the holes 1112 of the first retention members 1110, the cable holder members 712, 712 accommodated in the cavities 1141, 1142 of the rear wall 114. The second shield part 1B is mounted to the first shield part 1A, with the second bars 405 received in the second positioning grooves 1412, the second positioning members 407 received in the second positioning cavities 1410, the second retention members 1310 located in the second sunken portions 421, the tiny posts 421 inserted into the holes 1312 of the second retention members 1310. Four screw members 9 are utilized to keep the first shield part 1A and the second shield part 1B together.

An optional latch mechanism 5 is assembled to first shield part 1A of the housing 1. The latch mechanism 5 includes a latch member 51, an actuator 52 and a pull tape 53 attached to a rear portion of the actuator 52. The latch member 51 has a latch portion 511 disposed above first mating portion 12 of the housing 1. The actuator 52 is partially shielded by cap member 5.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A cable assembly, comprising:

a housing has a receiving space, said receiving space including a hollow portion and a mating port located in front of the hollow portion;

a spacer located in the receiving space;

a first and second printed circuit boards partially enclosed within the spacer and arranged apart from one another, both the first and second printed circuit boards having mating interfaces extending into the mating port and mounting portions disposed in the hollow portion;

a metallic plate assembled to the spacer and disposed between the pair of first and second printed circuit boards;

a plurality of cables coupled to the mounting portions of the pair of first and second printed circuit boards, respectively.

2. The cable assembly as recited in claim 1, wherein at least a conductive hole is defined in each of the first and second printed circuit boards, wherein a through hole is defined in the metallic plate and a metal pin member is inserted through the through hole of the metallic plate and the conductive holes of the first and second printed circuit boards.

3. The cable assembly as recited in claim 1, wherein at least a bar is formed on a top surface or a bottom surface of the spacer, wherein corresponding positioning groove is defined in an interior side of a mating portion of the housing.

4. The cable assembly as recited in claim 1, wherein a pair of passages are respectively defined in an upper portion and a lower portion of the spacer to receive the first and second printed circuit boards.

5. The cable assembly as recited in claim 4, wherein the pair of passages are parallel to each other.

6. The cable assembly as recited in claim 4, wherein a groove is defined in the spacer and disposed between the passages to receiving the metallic plate.

7. The cable assembly as recited in claim 1, wherein mounting portions of the first and second printed circuit boards extending beyond back face of the spacer and a panel portion is formed on a back face of the spacer and disposed between the mounting portions of the first and second printed circuit boards.

8. The cable assembly as recited in claim 7, wherein the metallic plate is assembled to the spacer via a groove in the panel portion.

9. A cable assembly, comprising:

a metallic housing including a first shield part assembled to a second shield part to form a receiving space, said receiving space including a hollow portion and a mating port located in front of the hollow portion;

a first printed circuit board parallel to a second printed circuit board and enclosed within the receiving space, said first and the second printed circuit boards having mating interfaces extending into the mating port and mounting portions located in the hollow portion;

a metallic plate disposed between the first and second printed circuit boards, said metallic plate electrically connected to the metallic housing via at least a metallic pin; and a plurality of wires connected to the mounting portions of the first and second printed circuit boards; wherein the metallic plate is enclosed in a spacer and insulated from the first and second printed circuit boards.

10. The cable assembly as recited in claim 9, wherein the metallic pin member are further inserted through conductive holes of the first and second printed circuit boards.

11. The cable assembly as recited in claim 9, wherein the metallic plate is located at a middle section between the first and second printed circuit boards.

12. The cable assembly as recited in claim 9, wherein the metallic plate is parallel to the first and second printed circuit boards.

13. The cable assembly as recited in claim 9, wherein the spacer has a body portion and an engaging portion joining to the body portion, wherein the body portion and the engaging portion respectively received in the mating port and hollow portion of the metallic housing.

14. The cable assembly as recited in claim 13, wherein the body portion and the engaging portion engage with the metallic housing via retaining means.

15. The cable assembly as recited in claim 13, wherein a panel portion extends rearward from back surface of the engaging portion of the spacer and located between the mounting portions of the first and second printed circuit boards.

16. The cable assembly as recited in claim 15, wherein the metallic plate is inserted into the spacer via a groove recessed forwardly from a back face of the panel portion.

17. A cable connector assembly comprising:

a casing defining a receiving cavity;

vertically aligned upper and lower printed circuit boards respectively located at upper and lower levels while commonly received in the receiving cavity in a parallel relation with each other;

upper and lower cables offset from each other vertically to be located at the upper and the lower levels, respectively, and further offset from each other horizontally to connect to different positions of the corresponding upper and lower printed circuit boards in a transverse direction so as to have the whole assembly in a dense arrangement without interference; wherein a grounding plate is located between the upper printed circuit board and the lower printed circuit board; wherein each of said upper cable and lower cables have corresponding wires respectively mounted to opposite upper and lower surfaces of each of the upper and lower printed circuit boards.

* * * * *